US008967523B2

(12) United States Patent
Huang

(10) Patent No.: US 8,967,523 B2
(45) Date of Patent: Mar. 3, 2015

(54) SHEET ROLLER DISPENSER

(76) Inventor: Tse-Wei Huang, Lugang Township, Changhua County (TW)

( * ) Notice: Subject to any disclaimer, the term of this patent is extended or adjusted under 35 U.S.C. 154(b) by 619 days.

(21) Appl. No.: 13/029,804

(22) Filed: Feb. 17, 2011

(65) Prior Publication Data

US 2012/0211583 A1 Aug. 23, 2012

(51) Int. Cl.

| | |
|---|---|
| ***B65D 85/02*** | (2006.01) |
| ***B65H 49/00*** | (2006.01) |
| ***B65H 75/00*** | (2006.01) |
| ***A47K 10/38*** | (2006.01) |

(52) U.S. Cl.
CPC ..... *A47K 10/3827* (2013.01)
USPC ..... 242/588.3; 242/402; 242/405

(58) Field of Classification Search
USPC ..... 242/588, 588.3, 588.5, 402, 405, 595, 242/596.8, 597.8, 598.5, 598.6
See application file for complete search history.

(56) References Cited

U.S. PATENT DOCUMENTS

| | | | | | |
|---|---|---|---|---|---|
| 1,122,672 | A * | 12/1914 | Winter et al. | ..... | 225/42 |
| 1,168,703 | A * | 1/1916 | Bauer | ..... | 242/588.3 |
| 2,253,744 | A * | 8/1941 | Witt | ..... | 225/43 |
| 2,276,414 | A * | 3/1942 | Morehouse et al. | ..... | 225/42 |
| 2,462,776 | A * | 2/1949 | Price | ..... | 225/33 |
| 3,368,522 | A * | 2/1968 | Cordis | ..... | 118/43 |
| 5,660,313 | A * | 8/1997 | Newbold | ..... | 225/42 |
| 6,098,836 | A * | 8/2000 | Gottselig | ..... | 221/45 |
| 6,446,808 | B1 * | 9/2002 | Paul et al. | ..... | 206/494 |
| 6,763,988 | B2 * | 7/2004 | Huang | ..... | 225/43 |

* cited by examiner

*Primary Examiner* — Emmanuel M Marcelo
*Assistant Examiner* — Angela Caligiuri
(74) *Attorney, Agent, or Firm* — Alan D. Kamrath; Kamrath IP Lawfirm, P.A.

(57) ABSTRACT

A sheet roller dispenser has a case with an interior for an accommodating space to receive a sheet roll. The case has an elongated hole longitudinally defined on a side face. An extension plate with a tongue extending upward is formed below the elongated hole at a central section of the elongated hole, and a corresponding pressing block is formed above the elongated hole to align with the extension plate. The sheet roll has a dotted line formed between two adjacent sheet units, and a slit is defined at a center section of the dotted line. When a free end of the sheet roll is pulled out from the case via the elongated hole, the tongue inserts into the slit of the dotted line to act as a stop, so that the pulled out sheet unit is separated apart from sheet roll easily and conventionally in operation by tearing along the dotted line.

5 Claims, 11 Drawing Sheets

SHEET ROLLER DISPENSER

BACKGROUND OF THE INVENTION

1. Field of the Invention

The present invention relates to a sheet roller dispenser and, more particular, to a sheet roller dispenser that accommodates a plastic bag roll, a toilet tissue roll, a paper towel roll, etc. and allows users to easily and conveniently separate one sheet unit by pulling.

2. Description of Related Art

A current plastic bag, toilet tissue, or paper towel is shaped continuously in a sheet wound in a roll for package and transportation convenience. The sheet has a dotted line formed between two adjacent sheet units to allow sellers or consumers to separate one unit from the roll by pulling to tear at the dotted line, which is a most common way to take the sheet unit in daily life. However, when breaking the sheet at the dotted line, the user has to hold the roll by one hand and pull the sheet unit at the free end by the other hand until the sheet unit is separated from the roll. If the user does not hold the roll well, the plastic bag roll, the toilet tissue roll, or the paper towel roll will be loose and in a mess, so that the user needs to rewind the sheet. Therefore, although the plastic bag, the toilet tissue, or the paper towel shaped in a roll is convenient in package and transportation, it is still inconvenient in use, because the user has to use both hands to take the sheet unit by pulling.

SUMMARY OF THE INVENTION

A main objective of the present invention is to provide a sheet roller dispenser that is convenient in operation by using one hand only.

To achieve the foregoing objective, the sheet roller dispenser comprises:

a case with an accommodating space for receiving a sheet roll, with the case having an elongated hole defined on a longitudinal side face;

an extension plate with a tongue extending upward, with the extension plate formed on the case below the elongated hole; and a pressing block formed on the case above the elongated hole to align with the extension plate;

with the sheet roll composed of multiple sheet units and having multiple dotted lines between each adjacent two of the multiple sheet units; and with each dotted line having a slit to allow the tongue to penetrate via the slit.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
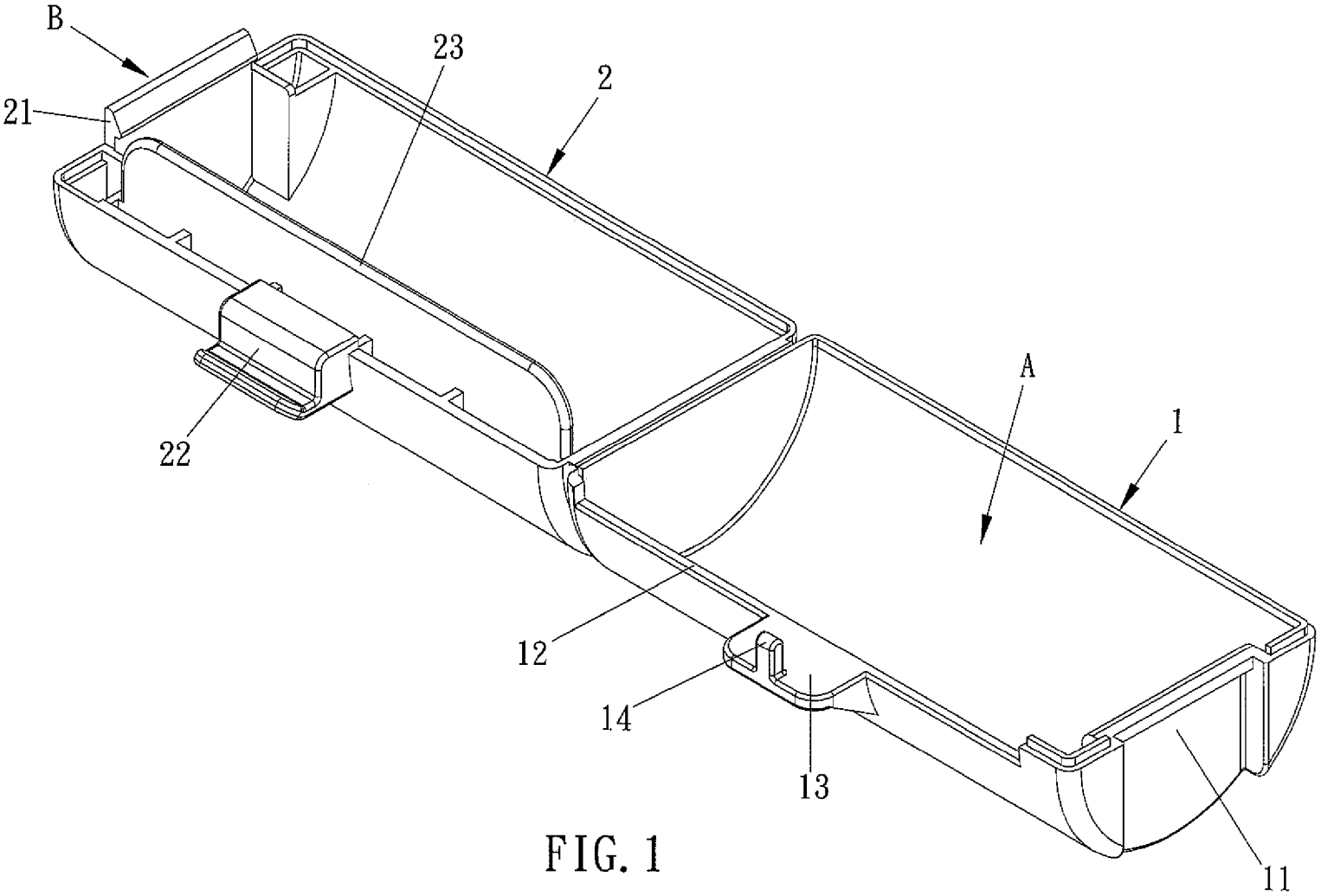
FIG. 1 is a perspective view of a first embodiment of a sheet roller dispenser in accordance with the present invention, with the sheet roller dispenser open.
Figure 2:
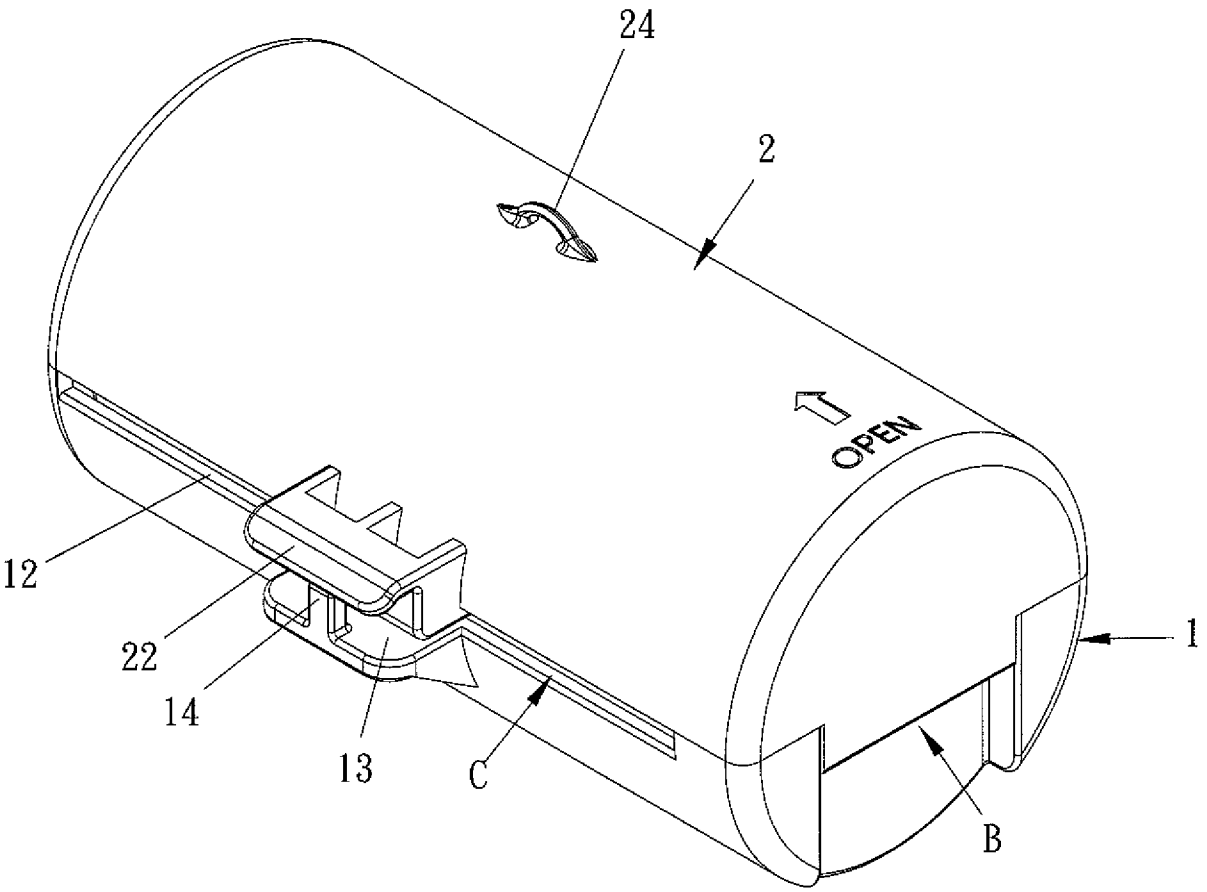
FIG. 2 is a perspective view of the sheet roller dispenser of FIG. 1, with the sheet roller dispenser closed.
Figure 3:
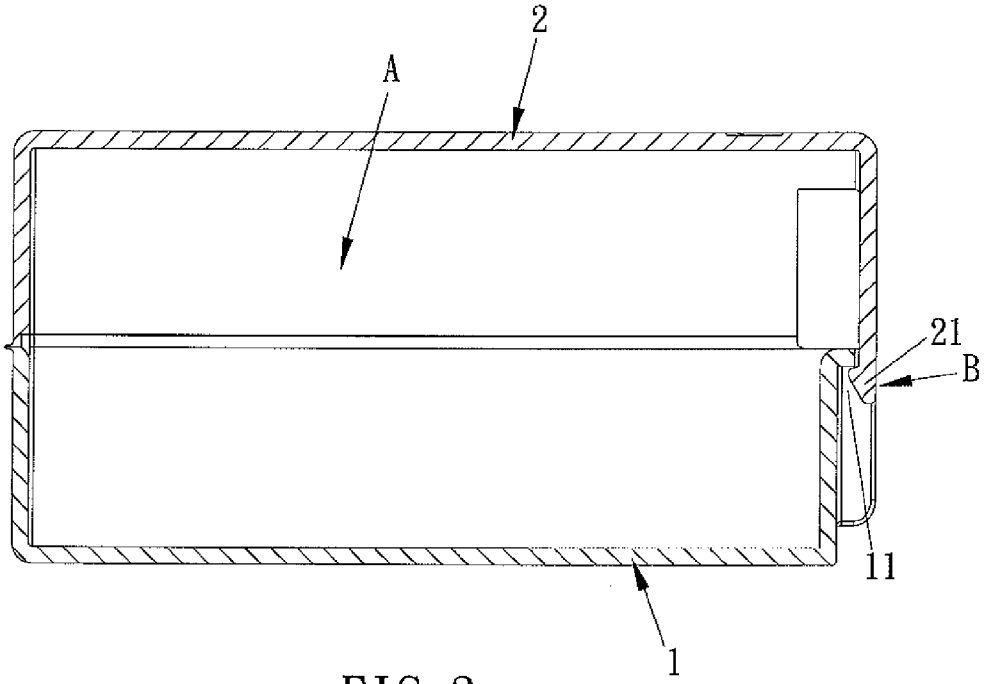
FIG. 3 is a longitudinal cross-sectional view of the sheet roller dispenser in FIG. 2.
Figure 4:
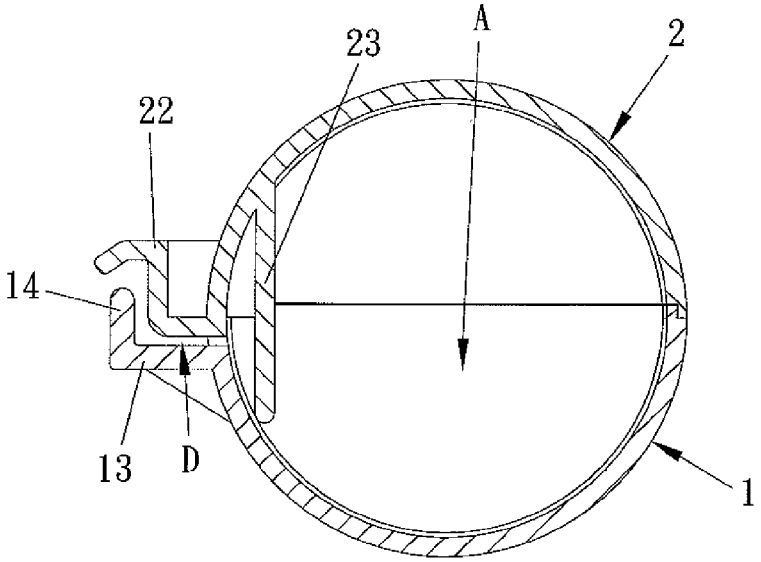
FIG. 4 is a lateral cross-sectional view of the sheet roller dispenser in FIG. 2.
Figure 5:
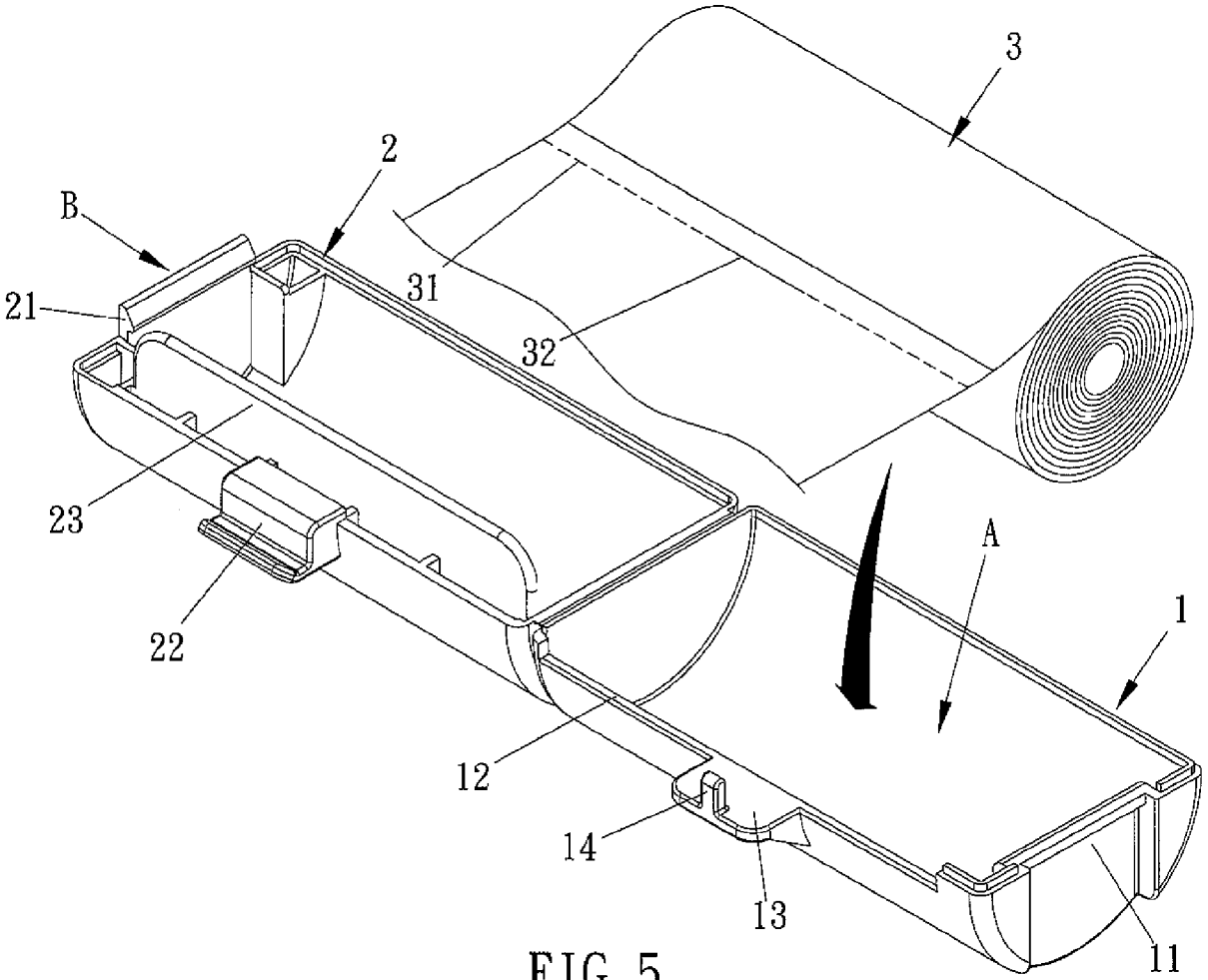
FIG. 5 is an operational perspective view of receiving a sheet roll inside the sheet roller dispenser.

A sheet roller dispenser in accordance with the present invention has a case with an interior for an accommodating space to receive a sheet roll. The case has an elongated hole longitudinally defined on a side face. An extension plate with a tongue extending upward is formed below the elongated hole at the central section of the elongated hole, and a corresponding pressing block is formed above the elongated hole to align with the extension plate. The sheet roll has a dotted line formed between two adjacent sheet units, and a slit is defined at a center of the dotted line. When a free end of the sheet roll is pulled out from the case via the elongated hole, the tongue inserts into the slit of the dotted line to act as a stop, so that the pulled out sheet unit is separated apart from the sheet roll easily and conventionally by tearing along the dotted line in operation.

As shown in FIGS. 1 to 5, a first preferred embodiment of a sheet roller dispenser in accordance with the present invention comprises a case composed of a first case body 1 and a second case body 2 in combination or formed integrally. The interior of the case has an accommodating space A. The first case body 1 and the second case body 2 are pivotally connected at pivotal ends to make the case open or closed operationally. A locking structure B is formed at free ends opposite to the pivotal ends of the first case body 1 and the second case body 2. The locking structure B has a recess 11 defined on the first case body 1 and a hook 21 formed on the second case body 2 to engage the recess 11 to lock the case after being closed. The first case body 1 has an elongated cutout 12 at a longitudinal edge of the opening and has an extension plate 13 formed below the elongated cutout 12. The extension plate 13 has a tongue 14 formed thereon and protruding upward. The second case body 2 has a pressing block 22 formed at a longitudinal edge of the opening corresponding to the extension plate 13. A trim plate 23 is formed inside the second case body 2 near the pressing block 22. When the second case body 2 covers the first case body 1, the elongated cutout 12 turns into an elongated hole C, and the extension plate 13 is below the elongated hole C at the central section. Correspondingly, the pressing block 22 is above the elongated hole C. A gap D (shown in FIG. 4) is defined between the extension plate 13 and the pressing block 22. Preferably, the trim plate 23 extends downward to exceed the elongated hole C but does not abut the first case body 1.

Figure 6:
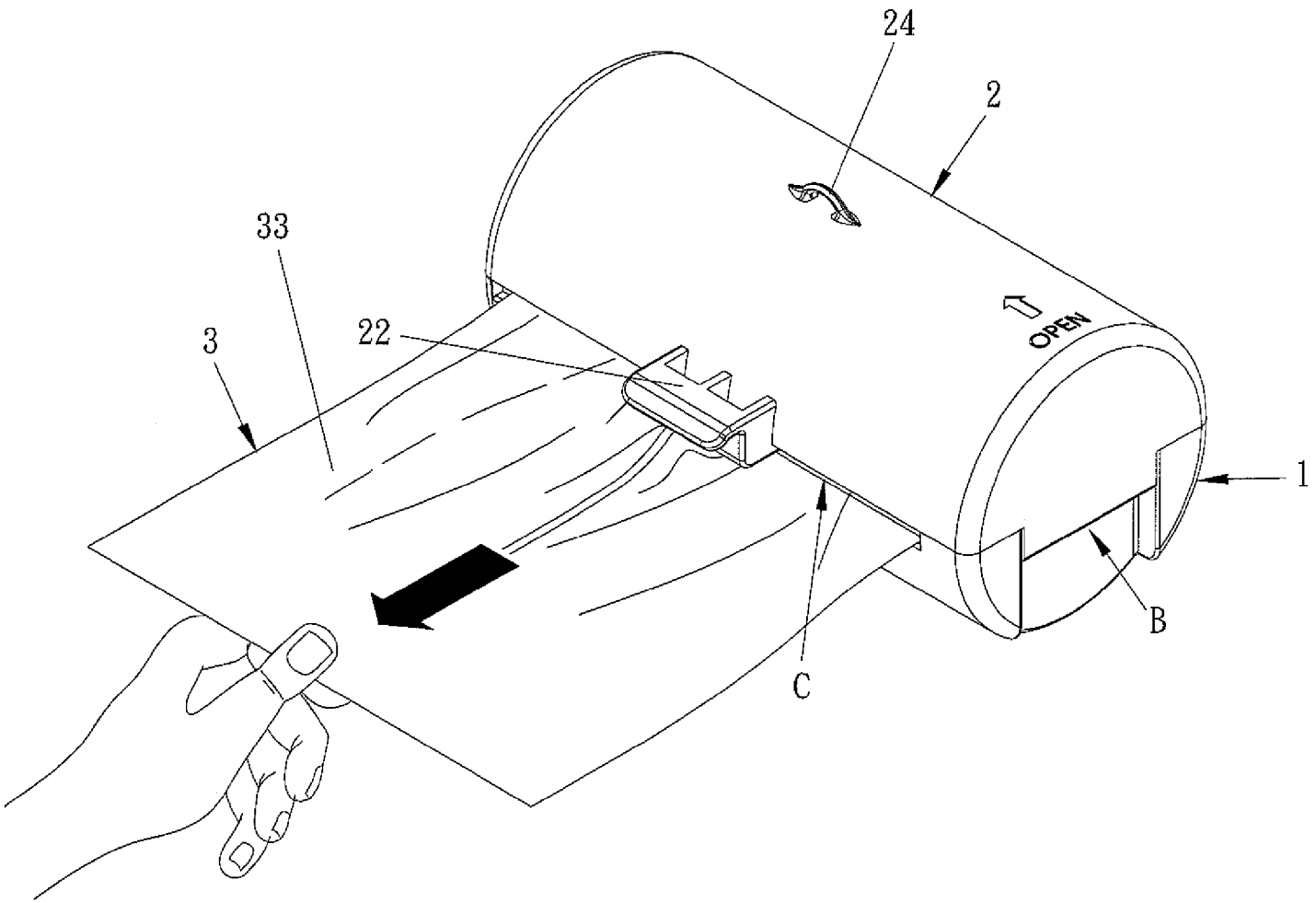
FIG. 6 is an operational perspective view of pulling a sheet unit out from the sheet roller dispenser.
Figure 7:
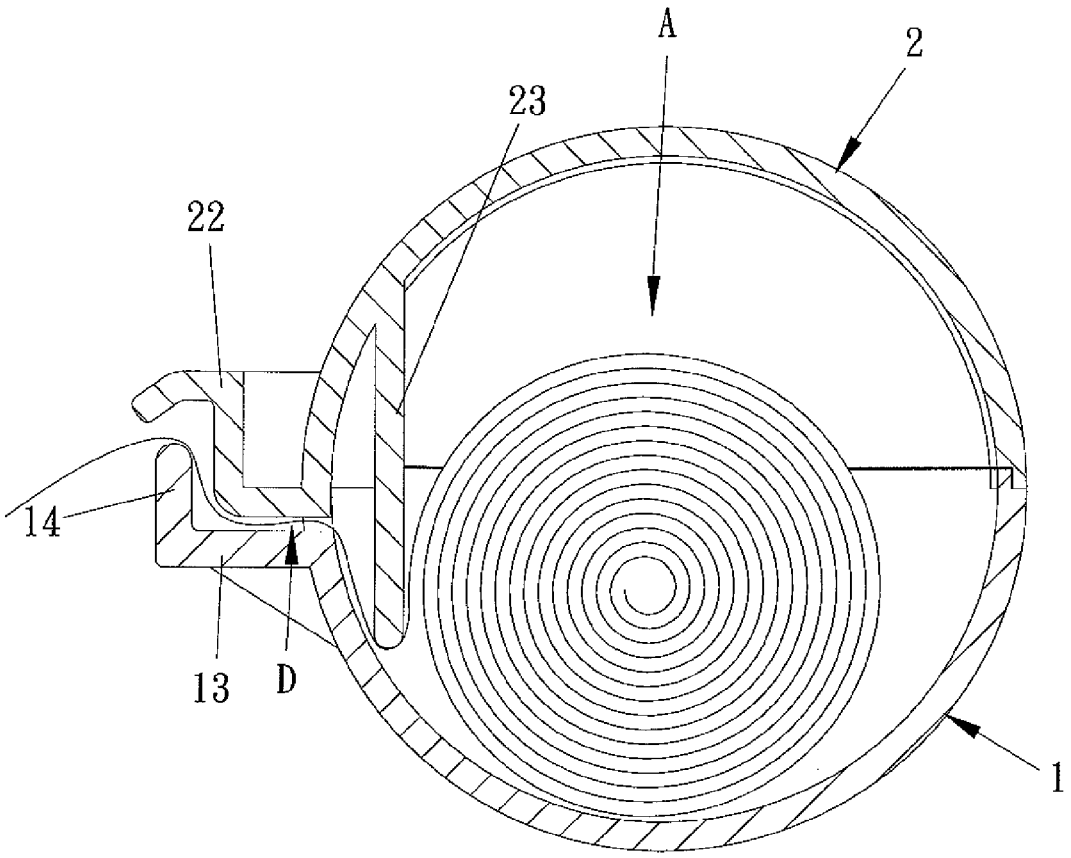
FIG. 7 is a lateral cross-sectional view of the sheet roller dispenser in FIG. 6.
Figure 8:
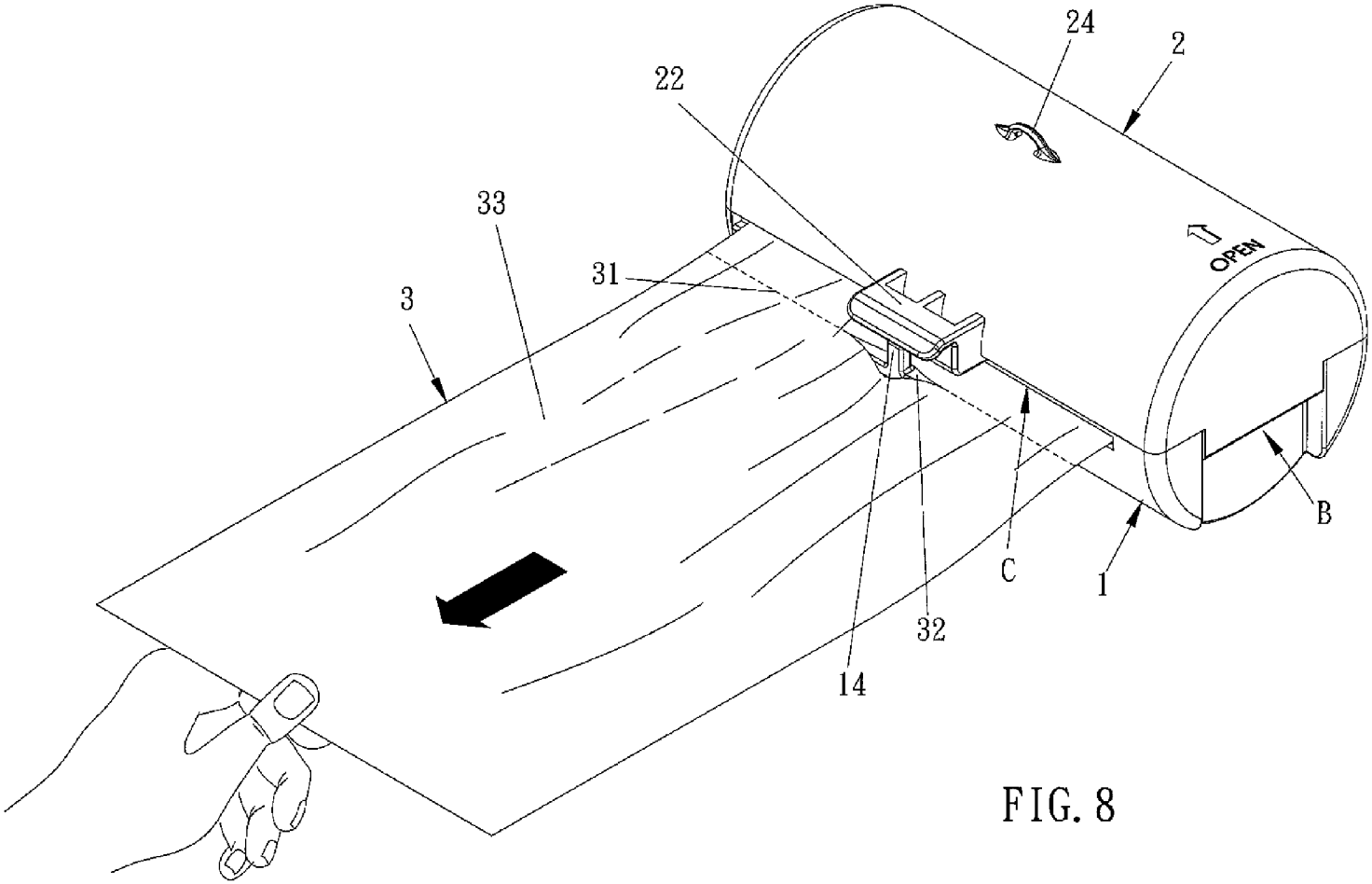
FIG. 8 is an operational perspective view of further pulling the sheet unit out from the sheet roller dispenser until a next sheet unit is stopped.
Figure 9:
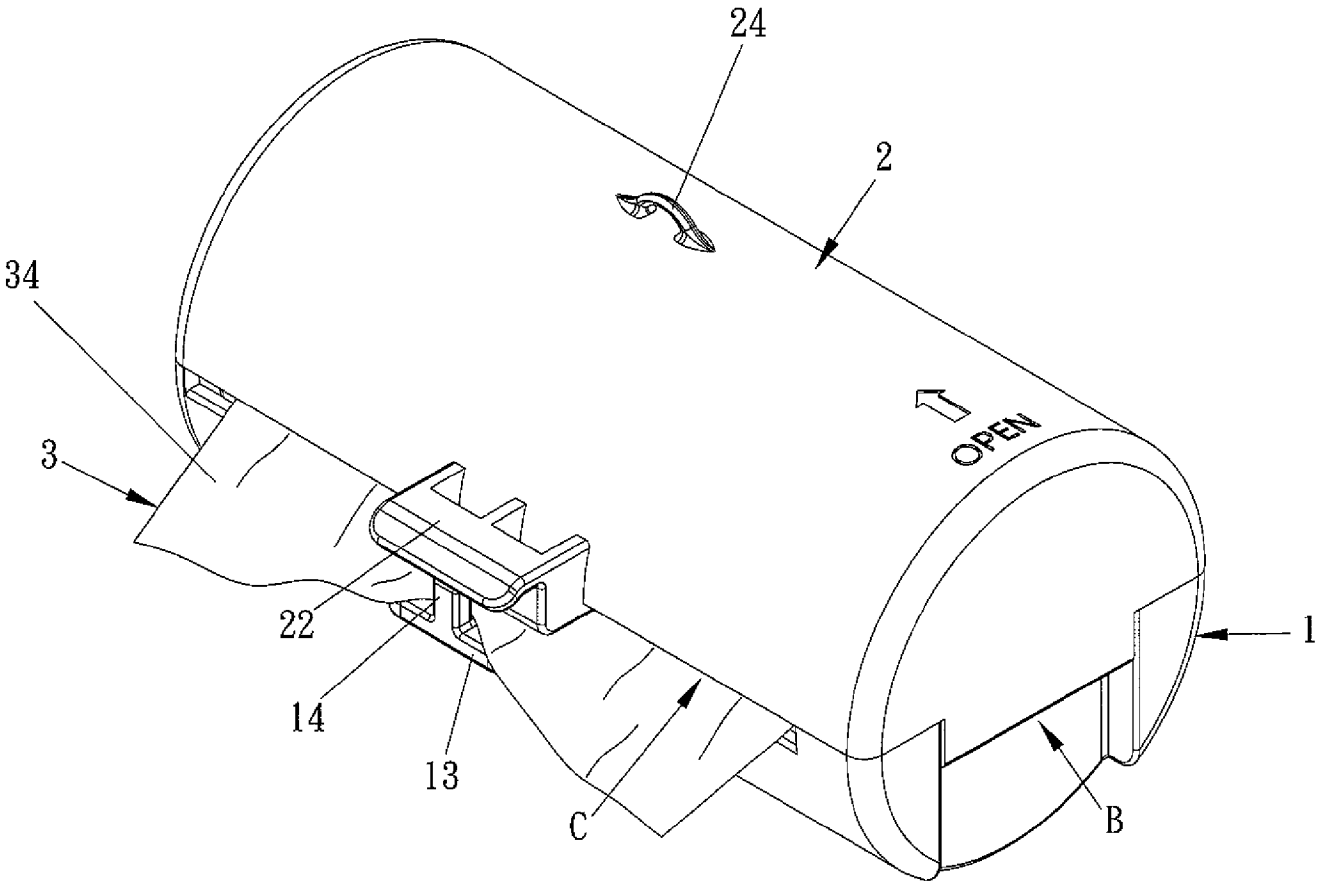
FIG. 9 is a perspective view of the sheet roller dispenser, with the sheet unit completely removed.

When the sheet roller dispenser is in use, the accommodating space A is loaded with a sheet roll 3, which can be a plastic bag roll, a toilet paper roll, a paper towel roll, etc., composed of multiple sheet units divided by multiple dotted lines 31. More particularly, each dotted line 31 has a slit 32 with a length larger than the width of tongue 14. As shown in FIGS. 6 and 7, when a free end of the sheet roll 3, i.e. a first sheet unit 33, is pulled out via the gap D between the extension plate 13 and the pressing block 22 and via the elongated hole C, the first sheet unit 33 is flattened by the trim plate 23 and slightly damped by the pressing block 22. After passing the first sheet unit 33 over the pressing block 22, the tongue 14 of the first case body 1 inserts into the slit 32 at the middle of the dotted line 31 to stop the second sheet unit 34 being pulled out. If the user keeps pulling as shown in FIG. 9, the first and second sheet units 33, 34 are torn at the dotted line 31 to obtain a single sheet unit of the plastic bag, the toilet paper or the paper towel.

After tearing, the second sheet unit 34 slightly extends out from the elongated hole C, because the tongue 14 is located at an outer edge of the extension plate 13. Thus, the second sheet unit 34 is enabled to be pulled out by lifting slightly to disengage from the tongue 14 of the first case body 1 until the tongue 14 inserts into the next slit 32 on the dotted line 31 again.

Figure 10:
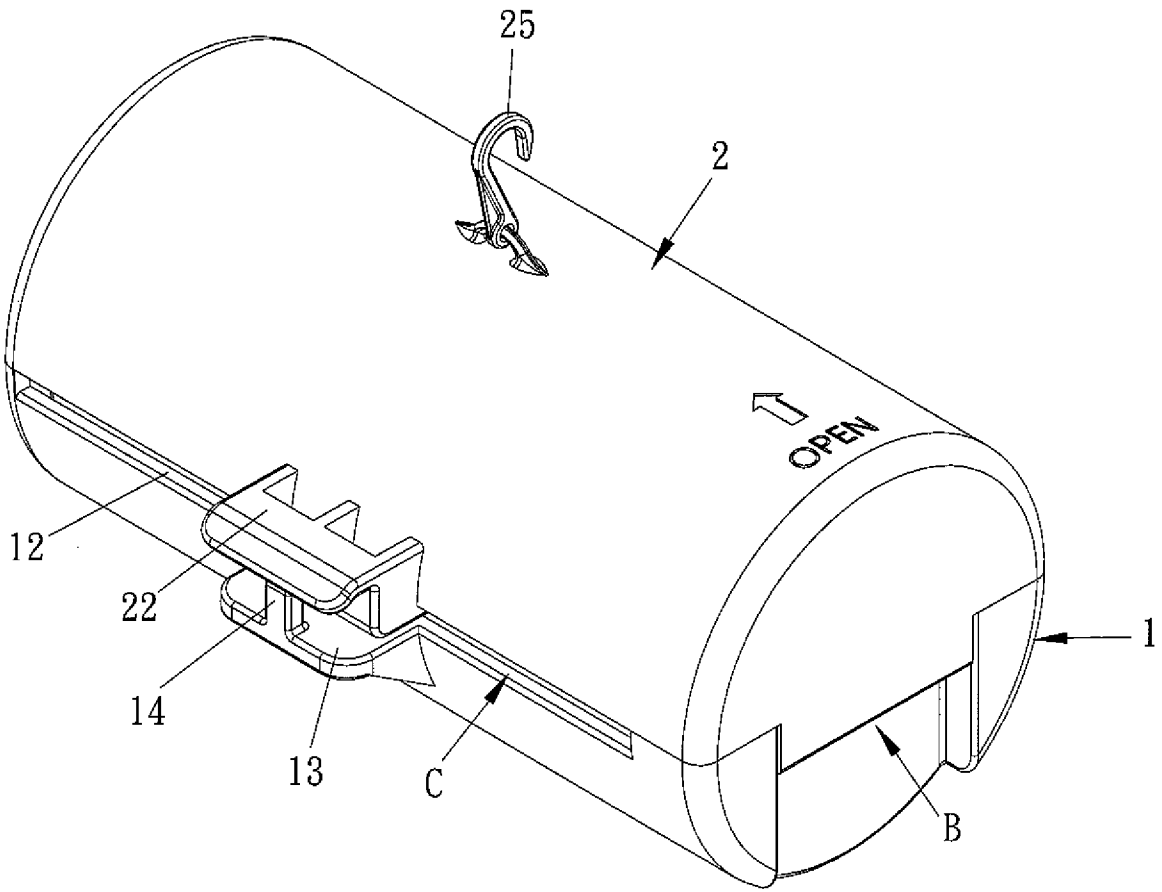
FIG. 10 is a perspective of a second embodiment of the sheet roller dispenser in accordance with the present invention.

Moreover, the second case body 2 further has a ring 24. A second embodiment of the sheet roller dispenser of the present invention as shown in FIG. 10 has a hooking ear 25. The sheet roller dispenser can be suspended on the wall or other desired place by the ring 24 or the hooking ear 25.

Figure 11:
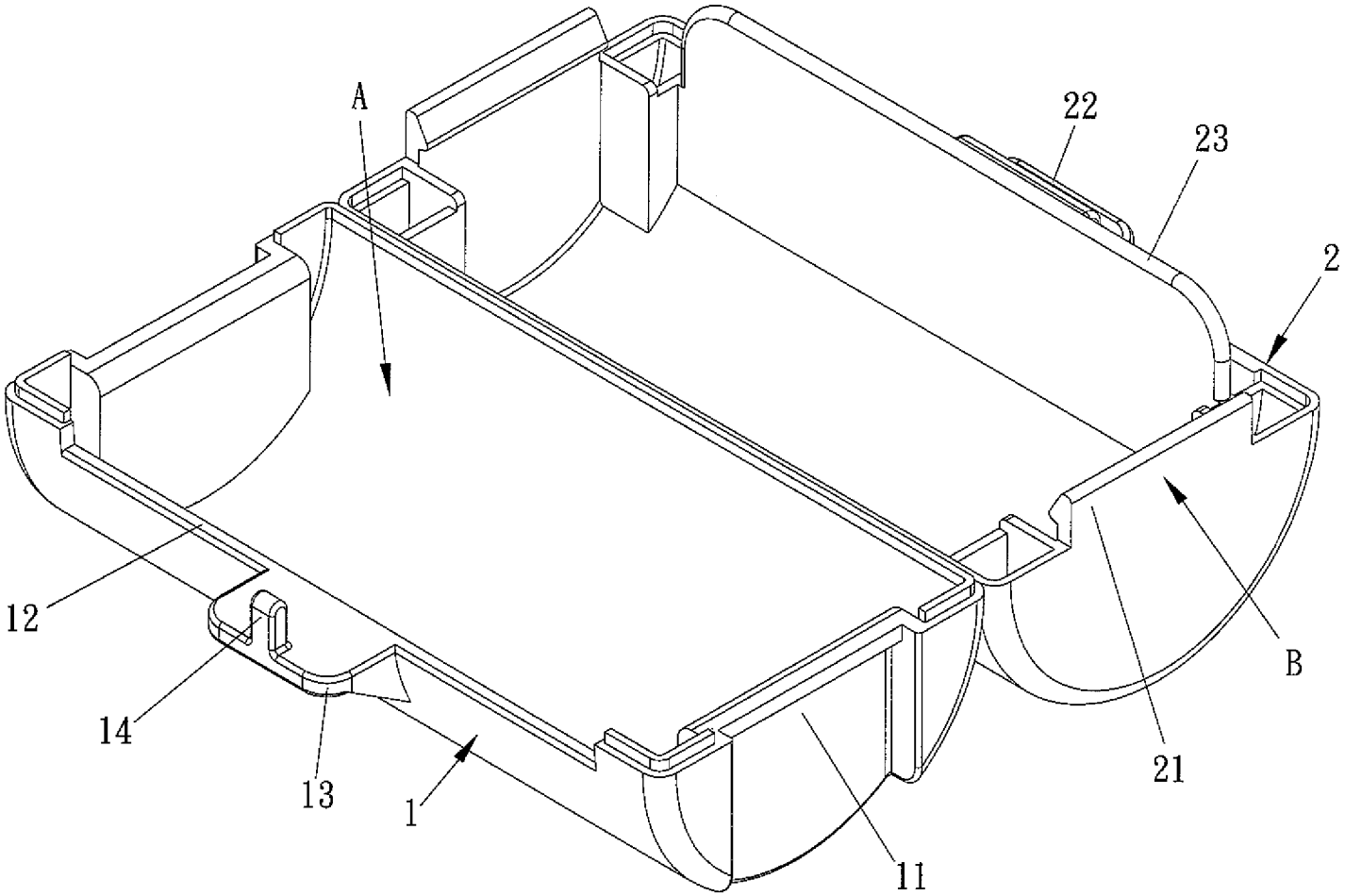
FIG. 11 is a perspective of a third embodiment of the sheet roller dispenser in accordance with the present invention.
Figure 12:
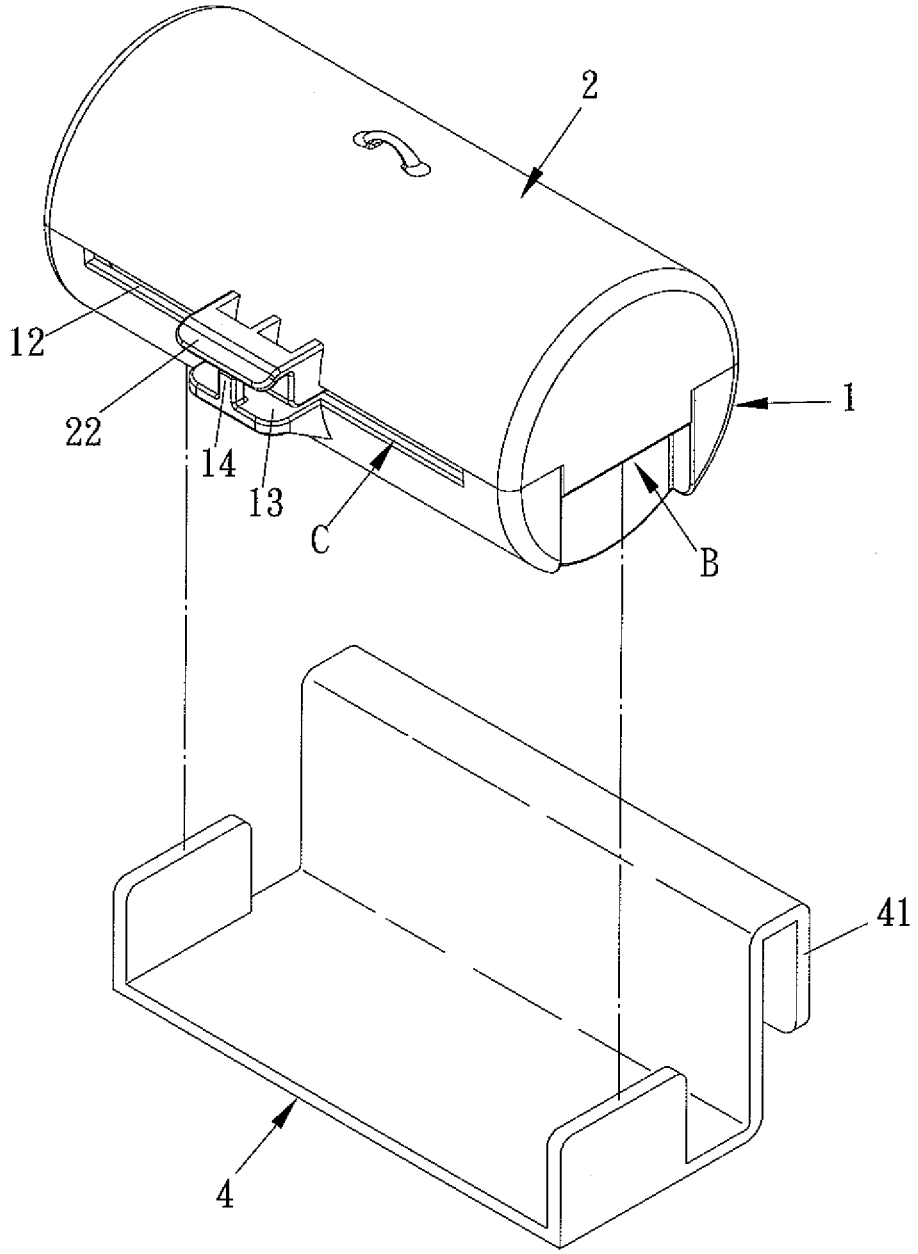
FIG. 12 is a perspective of a fourth embodiment of the sheet roller dispenser in accordance with the present invention.

A third embodiment of the sheet roller dispenser of the present invention as shown in FIG. 11 has the same features with the first embodiment except that the first case body 1 and the second case body 2 are pivotally combined at a longitudinal rear side to allow opening or closing the case. A fourth embodiment of the sheet roller dispenser of the present invention as shown in FIG. 12 further engages with a bracket 4. The bracket 4 has a clip 41 to easily attach to any proper device after the sheet roller dispenser is mounted thereon.

According to above description, the sheet roller dispenser of the present invention has the following advantages:

1. By having the elongated hole C and the tongue 14 formed below the elongated hole C and having the slit 32 at the central section on the dotted line 31 of the sheet roll 3, the tongue 14 inserts into the slit 32 of the dotted line 31 to stop the subsequent sheet units being pulled out and to facilitate breaking the dotted line 31 to obtain the single sheet unit of the plastic bag, the toilet paper or the paper towel without worrying about pulling excessive ones. Such operation is achieved by one hand easily and conveniently.

2. The pressing block 22 extending outward and formed over the elongated hole C constrains the sheet units to ensure the tongue 14 inserts into the slit 32 of the sheet roll 3 no matter what the pulling angle is when the sheet unit is pulled out. Thus, operation of separating the sheet unit is smooth and convenient.

3. The trim plate 23 is formed in the accommodating space A inside the second case body 2 near the elongated hole C and extended downward to trim the sheet unit during pulling and to keep the sheet roll 3 rolling in case the sheet roll 3 gets stuck by bias rolling. Thus, operation of separating the sheet unit is smooth.

Although this invention has been described in its preferred forms with a certain degree of particularity, it is understood that the present invention of the preferred forms has been made only by way of example and that numerous changes in the details of construction and the combination and arrangement of parts may be resorted to without departing from the spirit and scope of the invention.

What is claimed is:

1. A sheet roller dispenser comprising:

a case with an accommodating space for receiving a sheet roll, with the case having an elongated hole defined on a side face;

an extension plate with a tongue extending upward and having a width, with the extension plate formed on the case below the elongated hole; and a pressing block formed on the case above the elongated hole to align with the extension plate;

with the sheet roll composed of multiple sheet units and having multiple dotted lines each between adjacent two of the multiple sheet units; wherein each dotted line has a slit having a width greater than the tongue with the tongue penetrating the slit, wherein a trim plate is formed inside the accommodating space near the elongated hole, with the trim plate located in the accommodating space and spaced from the elongated hole, the extension plate and the pressing block, with the trim plate having a free edge spaced below the elongated hole, the extension plate and the pressing block, with the sheet roll extending from the accommodating space intermediate the free edge of the trim plate and the case to the elongated hole, wherein the tongue extends upwardly from a free edge of the extension plate, with the tongue having an extent above the free edge of the extension plate, with the elongated hole having an extent in the side face parallel to the extent of the tongue, with the free edge of the extension plate being spaced from the elongated hole, with the elongated hole located intermediate the free edge of the extension plate and the accommodating space, with the extent of the tongue being greater than the extent of the elongated hole with the tongue extending from the free edge of the extension plate to the extent of the tongue beyond the elongated hole.

2. The sheet roller dispenser as claimed in claim 1, wherein the case includes a first case body and a second case body pivotally connected at pivotal ends to allow the case to be open or closed operationally, with the trim plate and the pressing block connected to the second case body, with the extension plate connected to the first case body, with the trim plate extending from the second case body into the first case body; and wherein a locking structure is formed at free ends of the first case body and the second case body opposite to the pivotal ends.

3. The sheet roller dispenser as claimed in claim 2, wherein the first case body has an elongated cutout which turns into the elongated hole when the first case body and the second case body are combined.

4. The sheet roller dispenser as claimed in claim 1, wherein the sheet roll defines an axis, wherein the pressing block includes a first plate extending away from the case parallel to the extension plate above the elongated hole and radially relative to the axis, a second plate extending from the first plate parallel to the tongue and spaced from the case, and the third plate extending from the second plate away from the case and beyond the tongue, with the third plate spaced from the case and having a free edge, with the tongue located intermediate the free edge of the third plate and the first and second plates.

5. The sheet roller dispenser as claimed in claim 4, wherein the third plate includes a first section connected to the second plate parallel to and spaced from the extension plate and the first plate and a second section extending from the first section at an obtuse angle towards the tongue, with the first section being intermediate the second section and the second plate.

* * * * *